United States Patent [19]

Griffith et al.

[11] 4,154,021

[45] May 15, 1979

[54] METHOD AND MEANS FOR CONTINUOUSLY DELINTING COTTONSEED

[75] Inventors: Victor D. Griffith, Plainview; Clois N. Cato, Vernon; James G. Sims, Plainview, all of Tex.

[73] Assignee: Pioneer Hi-Bred International, Inc., Des Moines, Iowa

[21] Appl. No.: 864,594

[22] Filed: Dec. 27, 1977

[51] Int. Cl.[2] ..... D01B 1/04

[52] U.S. Cl. ..... 47/58; 19/41

[58] Field of Search ..... 47/58, DIG. 9; 19/40–41

[56] References Cited

U.S. PATENT DOCUMENTS

| | | | |
|---|---|---|---|
| 297,193 | 4/1884 | Taylor | 47/58 |
| 307,190 | 10/1884 | Green | 47/58 |
| 389,739 | 9/1888 | Cooper | 47/58 |
| 1,425,688 | 8/1922 | Polhamus | 47/58 |
| 1,718,332 | 6/1929 | Cloer | 47/58 |
| 2,308,883 | 1/1943 | Kettenbach | 47/58 |

FOREIGN PATENT DOCUMENTS

| | | | |
|---|---|---|---|
| 204442 | 10/1923 | United Kingdom | 47/DIG. 9 |

*Primary Examiner*—Robert E. Bagwill

*Attorney, Agent, or Firm*—Zarley, McKee, Thomte, Voorhees & Sease

[57] ABSTRACT

The apparatus for continuously delinting cottonseed comprises a closed housing having upper, lower and opposite end portions with an elongated drum rotatably mounted within the housing. The drum is provided with open intake and discharge ends positioned inwardly of the opposite end portions of the housing and is rotated by a conventional power means. A cottonseed supply conduit extends into the housing and is in communication with the intake end of the drum for supplying cottonseeds thereto. A discharge conduit extends from the housing and is in operative communication with the discharge end of the drum for conveying the lint and cottonseeds outwardly from the housing. The housing is in communication with a delinting gas such as hydrochloric acid. Seals are positioned in the supply conduit and discharge conduit for preventing the escape of delinting gas from the housing during the delinting process. The method of delinting comprises the steps of:

(a) supplying previously heated cottonseed to the interior of a rotatable drum positioned in a closed housing;

(b) passing the cottonseed through the rotatable drum so as to tumble the same while subjecting the cottonseed to delinting gas;

(c) discharging the cottonseed and lint from the housing.

7 Claims, 3 Drawing Figures

METHOD AND MEANS FOR CONTINUOUSLY DELINTING COTTONSEED

BACKGROUND OF THE INVENTION

This invention relates to a method and means for delinting cottonseed and more particularly to a continuous method and means for delinting cottonseed. Many types of devices and methods have been employed for removing the fiber or lint from cottonseed. The common practice is to delint the cottonseed in large batches by subjecting the cottonseed to sulfuric or hydrochloric acid. The batch delinting process has some shortcomings since the seed going into the batch drum either comes out properly or improperly. If the seed comes out improperly, it is too late to make adjustments for that run without handling the entire quantity a second time. Additionally, the quality control of the delinted seed is quite difficult in batch processes since heat is generated from the chemical reaction of the cottonseed and gas.

A still further disadvantage of the batch method of delinting cottonseed is that equipment following the delinting process is difficult to organize. In other words, a large batch of delinted cottonseed is fed to the "downstream" equipment which places large strains on the equipment at irregular intervals. The batch process also makes it difficult to permit instant removal of the discard lint as well as introducing cooling air to the seed immediately after delinting.

Therefore, it is a principal object of the invention to provide an improved method and means for delinting cottonseed.

A still further object of the invention is to provide a continuous delinting apparatus and method of using the same.

A still further object of the invention is to provide a cottonseed delinting apparatus including means at the intake and discharge ends thereof for preventing the escape of delinting gas therefrom.

A still further object of the invention is to provide a delinting drum within a closed housing wherein the attitude of the drum may be varied.

A still further object of the invention is to provide a continuous delinting process which is more efficient than a continuous batch process.

A still further object of the invention is to provide a continuous delinting apparatus which is economical of manufacture and durable in use.

These and other objects will be apparent to those skilled in the art.

SUMMARY OF THE INVENTION

Figure 1:
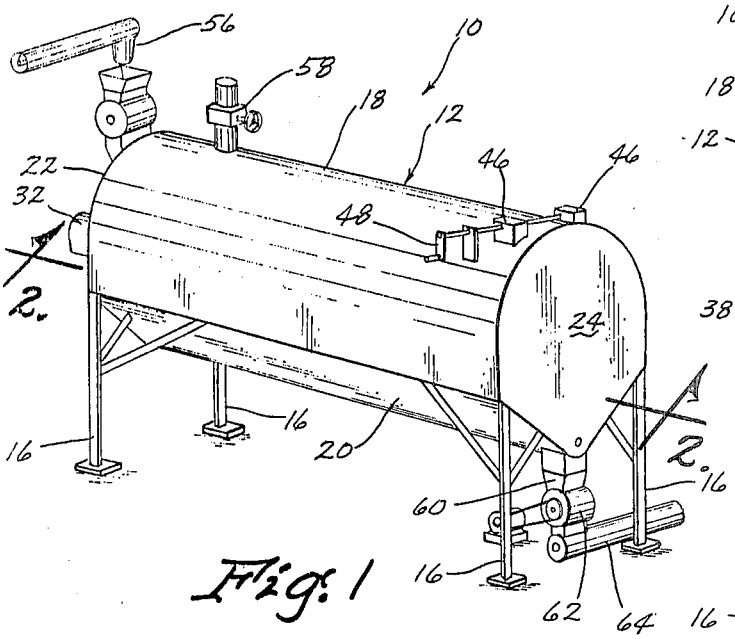
FIG. 1 is a perspective view of the apparatus of the invention.

An elongated rotatable drum having open intake and discharge ends is rotatably mounted within a sealed housing which is filled with delinting gas. Previously heated cottonseed is supplied through a valve into the interior of the housing so as to be supplied to the intake end of the rotatable drum. The cottonseed is tumbled and subjected to the delinting gas as it passes from the intake end to the discharge end of the drum. The lint and cottonseed is discharged from the discharge end of the drum and is conveyed outwardly from the housing through a valve. Means is provided for changing the pitch or attitude of the rotatable drum.

DESCRIPTION OF THE PREFERRED APPARATUS AND METHOD

In the drawings, the numeral 10 refers generally to the delinting apparatus generally comprising a closed housing 12 and a drum 14 rotatably mounted therein. Preferably, housing 12 is constructed of stainless steel and is supported by a plurality of depending legs 16. For purposes of description, housing 12 will be described as comprising a top portion 18, bottom portion 20, and opposite end portions 22 and 24.

Figure 3:
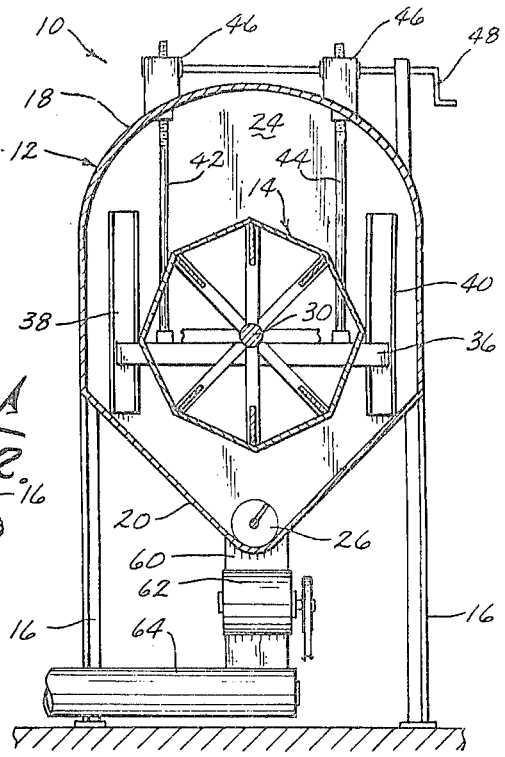
FIG. 3 is a sectional view seen on lines 3—3 of FIG. 2.
Figure 2:
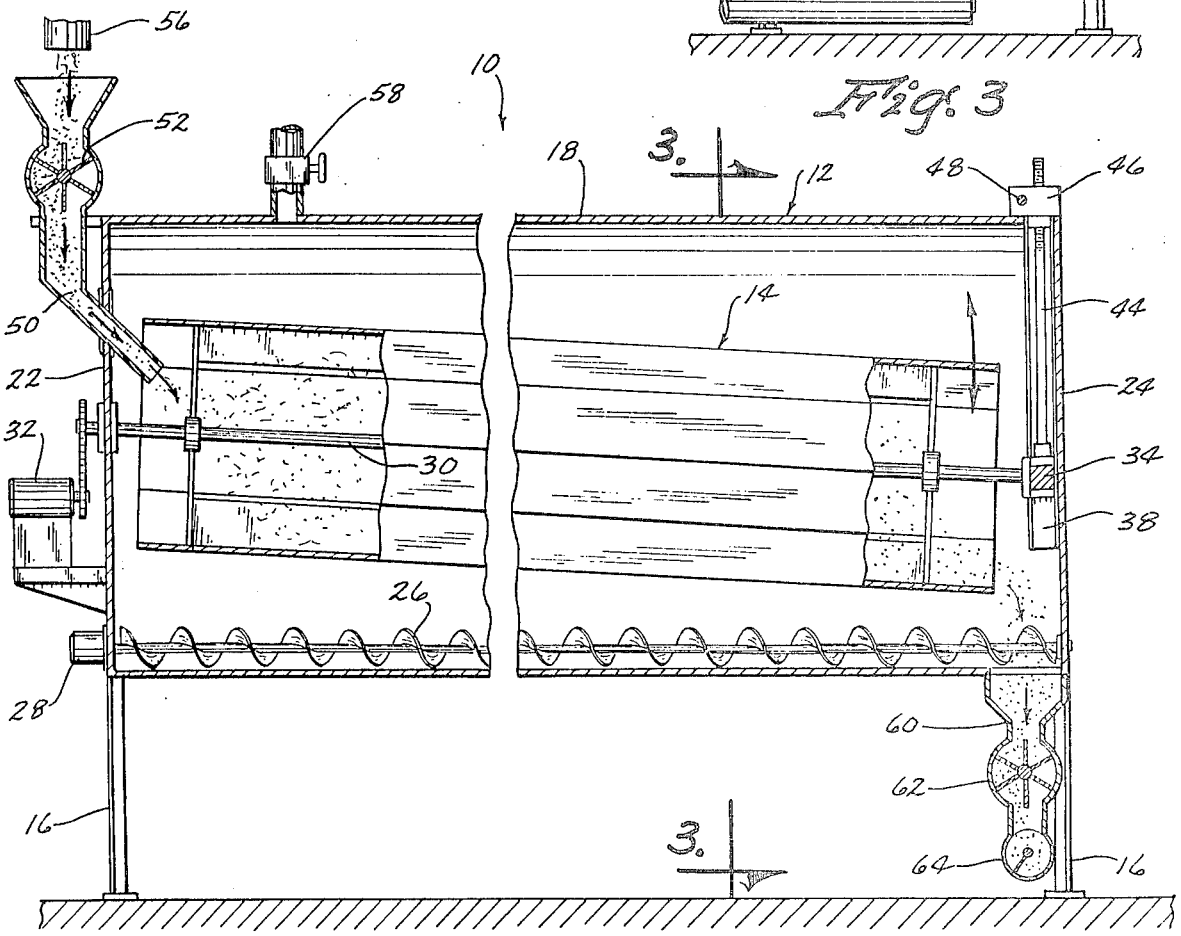
FIG. 2 is a partial sectional view as seen on lines 2—2 of FIG. 1.

Preferably, the bottom portion of the housing is V-shaped as illustrated in FIG. 3 and has a conveyor auger 26 positioned therein which is powered by motor 28. Conveyor 26 is provided to convey lint toward the discharge conduit. Drum 14 includes an elongated shaft 30 having one end thereof rotatably mounted in end portion 22 of housing 12 as seen in FIG. 2. Motor 32 is connected to the outer end of shaft 30 by conventional chains and sprockets. The other end of shaft 30 is rotatably mounted in a bearing referred to generally by the reference numeral 34. Bearing 34 is supported on support 36 which has its opposite ends vertically slidably mounted in channels 38 and 40. Threaded rods 42 and 44 are secured to support 36 and extend upwardly through the housing 12 as illustrated in FIGS. 1 and 3. A conventional gear drive apparatus 46 is operatively secured to the upper end of rods 42 and 44 for raising and lowering the rods 42 and 44 relative to the housing by means of the crank 48 which causes the discharge end of the drum to be raised or lowered relative to its intake end and relative to the housing.

The numeral 50 refers generally to a seed supply conduit which extends inwardly through end portion 22 of housing 12 for supplying the cottonseed to the intake end of the drum 14. The conduit 50 is provided with a plurality of rotatable vanes 52 disposed as illustrated in FIG. 2 which act as a seal to prevent the escape of gas from within housing 12 upwardly through the conduit 50. Vanes 52 are rotated by means of a conventional motor. Conduit 50 is adapted to receive the cottonseed from a conveyor referred to generally by the reference numeral 56 in a continuous fashion.

Housing 12 is provided with a gas inlet 58 at the upper end thereof which is in communication with a source of delinting gas such as hydrochloric acid. The numeral 60 refers generally to a discharge conduit, the upper end of which is in communication with the lower portion of housing 12 below the discharge end of the drum 14. Conduit 60 likewise includes a plurality of rotatable vanes 62 mounted therein which act as a seal for preventing the escape of delinting gas from within the housing. Vanes 62 are rotated by a conventional electric motor or the like.

In operation, crank 48 is initially rotated so as to achieve the desired pitch or attitude of the drum 14 for varying the speed of flow of the seed through the drum. The various motors are activated to cause the rotation of the drum 14, conveyor auger 26, vanes 52, vanes 62 and conveyor 64. Preferably, the cottonseed is preheated to 120° F. prior to being supplied to the intake end of the drum. The cottonseed is continuously fed to the drum 14 where it is tumbled and subjected to the delinting gas as it passes from the intake end to the discharge end thereof. The delinting gas removes the lint from the seed as it tumbles through the drum 14 and the lint and seed is discharged from the discharge end of the drum. The lint and seed are conveyed to the discharge conduit 60 and the conveyor auger 64 for further processing.

Thus it can be seen that a novel continuous delinting apparatus has been provided which permits the constant monitoring of the cottonseed to enable adjustments to be made should the monitoring warrant the same. The novel seals at the opposite ends of the housing prevent the escape of gas from the housing which is highly desirable since the hydrochloric acid is extremely toxic. It can also be appreciated that the ability of the discharge end of the drum to be raised or lowered permits the delinting time to be varied so as to achieve maximum efficiency. Thus it can be seen that the method and means accomplishess at least all of its stated objectives.

I claim:

1. A continuous cottonseed delinting apparatus comprising, a closed housing having upper, lower and opposite end portions, an elongated drum rotatably mounted within said housing and having open intake and discharge ends positioned inwardly of the opposite end portions of said housing, power means for rotating said drum relative to said housing, a cottonseed supply conduit extending into said housing and being in communication with said intake end of said drum, a discharge conduit extending from said housing and being in operative communication with the discharge end of said drum, means for introducing delinting gas into the interior of said housing and drum, first and second seal means in said supply and discharge conduits respectively for preventing the escape of delinting gas from said housing during the continuous delinting process, and means for supplying cottonseed to said supply conduit in a continuous manner.

2. The apparatus of claim 1 wherein adjustment means is secured to said drum for raising and lowering the discharge end thereof with respect to the intake end thereof.

3. The apparatus of claim 1 wherein an elongated conveyor means is mounted in the lower interior portion of said housing for conveying material towards said discharge conduit.

4. The apparatus of claim 1 wherein said first seal means comprises a plurality of rotatable vanes and means for rotating said vanes in unison to permit the passage of cottonseed through said supply conduit, said vanes being generally radially extended from a common axis and circumferentially spaced so that said supply conduit is sealed at all times by alternate ones of said vanes as said vanes are rotated.

5. The method of continuously delinting cottonseed, comprising the steps of:

(a) continuously supplying cottonseed to the interior of a rotatable drum positioned in a closed housing;

(b) continuously passing the cottonseed through the rotatable drum so as to tumble the same while subjecting the cottonseed to delinting gas;

(c) and discharging the cottonseed and lint from the housing.

6. The method of claim 5 wherein said cottonseed is preheated prior to being introduced into said drum.

7. The method of claim 6 wherein said cottonseed is preheated to approximately 120° F.

* * * * *